US008839488B2

(12) United States Patent
Lowe et al.

(10) Patent No.: US 8,839,488 B2
(45) Date of Patent: Sep. 23, 2014

(54) ADJUSTABLE HINGE

(75) Inventors: Mark Jeffrey Lowe, Bossier City, LA (US); Udhaya Bhaskar Nallamottu, Shreveport, LA (US)

(73) Assignee: Hardware Resources, Inc., Bossier City, LA (US)

( * ) Notice: Subject to any disclaimer, the term of this patent is extended or adjusted under 35 U.S.C. 154(b) by 824 days.

(21) Appl. No.: 11/705,488

(22) Filed: Feb. 12, 2007

(65) Prior Publication Data

US 2007/0289094 A1 Dec. 20, 2007

Related U.S. Application Data

(63) Continuation-in-part of application No. 11/471,195, filed on Jun. 20, 2006, now Pat. No. 7,594,300.

(51) Int. Cl.
*E05D 7/04* (2006.01)
*E05D 5/02* (2006.01)

(52) U.S. Cl.
CPC ..... *E05D 7/0407* (2013.01); *E05D 5/0276* (2013.01); *E05Y 2900/20* (2013.01)
USPC ..... 16/236

(58) Field of Classification Search
USPC ..... 16/236, 237, 238, 245, 246, 247, 249, 16/360, 361, 370, 336
See application file for complete search history.

(56) References Cited

U.S. PATENT DOCUMENTS 3,952,366 A * 4/1976 Rock et al. ..... 16/235
4,837,893 A * 6/1989 Wilson ..... 16/240
5,257,437 A * 11/1993 Salice ..... 16/239
5,353,476 A 10/1994 Domenig
5,392,493 A * 2/1995 Youngdale ..... 16/237
5,414,896 A 5/1995 Domenig
RE34,995 E 7/1995 Domenig
5,485,656 A 1/1996 Domenig
5,621,947 A * 4/1997 Fitz et al. ..... 16/249
5,781,967 A 7/1998 Domenig
5,826,305 A 10/1998 Domenig et al.
5,884,364 A 3/1999 Domenig et al.
5,920,958 A 7/1999 Domenig et al.
6,088,879 A * 7/2000 Gasser ..... 16/257
6,134,750 A * 10/2000 Salice ..... 16/238
6,148,479 A * 11/2000 Lin ..... 16/258
6,167,590 B1 1/2001 Domenig
6,249,934 B1 6/2001 Moser
6,463,626 B1 * 10/2002 Ferrari et al. ..... 16/236

(Continued)

FOREIGN PATENT DOCUMENTS

DE 3341325 A1 * 5/1985 ..... E05D 7/04
GB 1506252 A * 4/1978

*Primary Examiner* — Jeffrey O Brien
(74) *Attorney, Agent, or Firm* — Schultz & Associates, P.C.

(57) ABSTRACT

The invention disclosed provides a hinge capable of a vertical and overlay adjustment, comprised of a recessed hinge cup and a hinge arm connected to an attachment plate and an abutment plate which are further connected by a deformable hinge section. An overlay adjustment is provided by bending the deformable hinge section through use of an overlay adjustment screw fitted between the attachment plate and the abutment plate. The novel hinge provided is also adjustable vertically via an adjustment screw accessed by a portal in the attachment plate. The design is less complicated and therefore is lighter and less expensive than previous overlay adjustable hinges and allows delicate and semi-permanent adjustments to be made by a single installer.

6 Claims, 6 Drawing Sheets

(56) References Cited

U.S. PATENT DOCUMENTS

| | | | | |
|---|---|---|---|---|
| 6,532,626 | B2 * | 3/2003 | Muller et al. | 16/245 |
| D477,982 | S | 8/2003 | Domenig et al. | |
| 6,642,895 | B2 | 11/2003 | Zürcher et al. | |
| 6,647,591 | B1 | 11/2003 | Domenig et al. | |
| 6,694,567 | B1 | 2/2004 | Domenig et al. | |
| 6,810,563 | B1 | 11/2004 | Domenig et al. | |
| 6,996,877 | B2 | 2/2006 | Booker et al. | |
| 7,017,231 | B2 * | 3/2006 | Isele | 16/242 |
| D523,323 | S | 6/2006 | Domenig et al. | |
| 7,117,561 | B1 | 10/2006 | Domenig et al. | |
| 7,213,300 | B1 * | 5/2007 | Domenig et al. | 16/236 |
| 2003/0093877 | A1 * | 5/2003 | Hofer | 16/235 |
| 2004/0163211 | A1 * | 8/2004 | Rucker | 16/235 |
| 2004/0163213 | A1 * | 8/2004 | Isele | 16/245 |
| 2007/0136988 | A1 * | 6/2007 | Bullock | 16/245 |

* cited by examiner

ADJUSTABLE HINGE

CROSS-REFERENCE TO RELATED APPLICATIONS

This application is a Continuation-In-Part claiming priority benefit from U.S. patent application Ser. No. 11/471,195 entitled "Adjustable Hinge" filed on Jun. 20, 2006 now U.S. Pat. No. 7,594,300.

FIELD OF THE INVENTION

The present invention relates to adjustable hinges. In particular, the invention relates to adjustable hinges having a hinge arm capable of a vertical adjustment and an overlay adjustment.

BACKGROUND OF THE INVENTION

Cabinet doors for cabinets generally must be individually adjusted to compensate for manufacturing tolerances. Adjustment is generally required in more than one dimension. If the door has two or more hinges, as is usually the case, adjustment must be carried out on each hinge with respect to the other hinges. A "vertical adjustment" is required when the door does not seat properly with respect to the top and bottom of the cabinet frame. An "overlay adjustment" is a horizontal adjustment required when the door does not properly align with the sides of the cabinet frame.

Prior art hinges suffer from various disadvantages including difficulty in installation, difficulty of adjustment, instability of the adjustments made, complicated construction and high manufacturing costs.

U.S. Pat. No. 6,647,591 to Domenig et al. discloses a low profile, partial door overlay hinge having a hinge cup, an intermediate base hinge and top hinge arm segments. In order to accomplish an overlay adjustment, this device requires a complicated assembly necessitating several assembly connection points. Further, cam screws and eccentric screws are required to effectuate the adjustments. All of the above increases the manufacturing complexity and cost of the device.

U.S. Pat. No. 6,694,567 to Domenig et al. discloses an overlay hinge having a hinge cup, a base hinge arm segment and an L-shaped hinge arm segment. This device requires multiple plate hinge arm segments to achieve the overlay adjustment capability. The device of the '567 patent also requires multiple intricate and expensive pieces requiring complex assembly steps and hardware to function as an adjustable hinge.

U.S. Pat. No. 5,392,493 to Youngdale discloses a "pocket" hinge assembly including a cup mounted within a pocket formed in a cabinet door and an arcuate shaped, flexible base attached to the cabinet frame that allows two perpendicular adjustments. The horizontal adjustments are made by tightening or loosening a mounting screw which flattens or releases the arcuate shaped base. The Youngdale device requires the overlay adjustment to be actuated by a wood screw also used for mounting the hinge arm to the cabinet frame. Repeated adjustment of the wood screw results in an unstable mounting. The dual functionality of the wood screw also requires that the wood screw be larger than would otherwise be required, thereby limiting its use to cabinets having sufficient dimensions to support the larger screw sizes.

U.S. Pat. No. Re 34,995 to Domenig discloses an adjustable recessed door hinge having a hinge cup in a bore in a door member and a hinge arm securable to a cabinet member. The hinge cup has two slotted holes for receiving attaching screws that guide displacement of the hinge cup for a side-to-side adjustment. The invention of the '995 patent requires the adjustment of at least two mounting screws per hinge used to mount the hinge cup in order to effectuate an overlay adjustment. After repeated adjustment as is required to secure and adjust a door, the fit of newly inserted screws becomes unstable which ultimately results in an insecure mounting of the door on the cabinet.

SUMMARY OF INVENTION

The present invention addresses the need for a simply designed and adjustable hinge, particularly one including an overlay adjustment and a vertical adjustment with a minimum number of components that can be easily and economically manufactured and installed.

Accordingly, an embodiment of the present invention provides an adjustable hinge that includes a hinge cup adapted to be mounted in a cabinet door, a hinge arm biased by a hinge spring in one of an opened or closed positions, a pair of connected plates adjustable in two dimensions affixed to a cabinet frame, a single adjustment screw operable to make an overlay adjustment and a second screw or set of screws operable to make a vertical adjustment. The hinge arm includes a pivotable connection to the hinge cup leading to an attachment plate and an abutment plate. The abutment plate is positioned parallel with and nearly adjacent to the attachment plate by a semi-cylindrical deformable hinge section. The abutment plate includes an elongated hole. The elongated hole provides for attachment of the hinge to the cabinet frame and for vertical adjustment of the hinge. The attachment plate includes an access aperture that allows access to the mounting screw that secures the abutment plate to the cabinet frame and allows for vertical adjustment of the door. The attachment plate includes the adjustment screw that performs an overlay adjustment by biasing the attachment plate with respect to the abutment plate by bending the deformable hinge section.

Those skilled in the art will further appreciate the above-mentioned features and advantages of the invention together with other important aspects upon reading the detailed description that follows in conjunction with the drawings.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
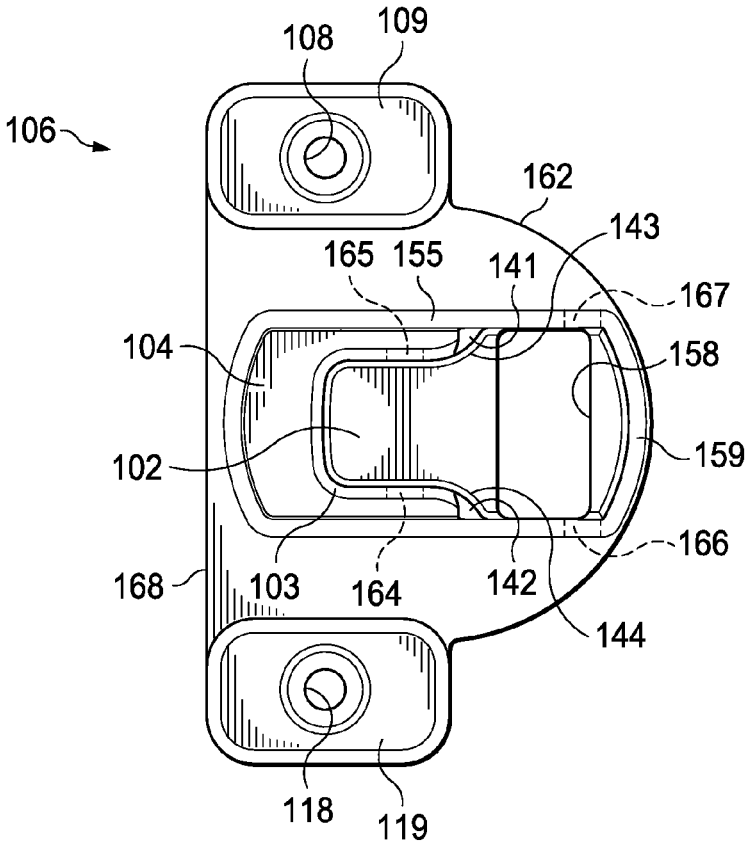
FIG. 1 is a plan view of a hinge cup of a preferred embodiment of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
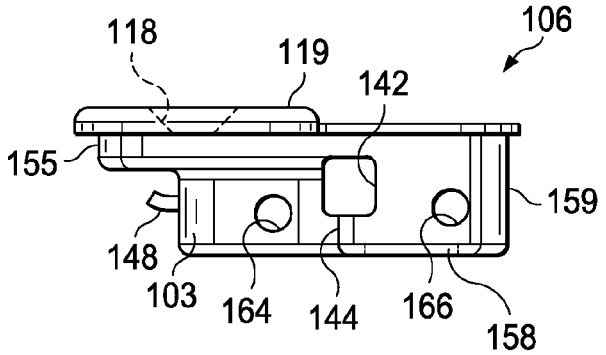
FIG. 2 is an elevation view of a hinge cup of a preferred embodiment of the present invention.

Hinge cup 106 is shown in FIGS. 1 and 2. Hinge cup 106 has a semicircular shaped brim 162 opposite ledge 168 encompassing a generally rectangular shaped indention or cup. Ledge 168 connects flange 109 and flange 119. Flange 109 defines a circular flange hole 108 and flange 119 defines a circular flange hole 118. The indention or cup of hinge cup 106 includes two different horizontal surfaces, cup floor 102 and cup shelf 104. Cup floor 102 forms the base of the cup shape and includes a generally rectangular shaped aperture floor hole 158. Cup shelf 104 is generally a "horseshoe shaped" horizontal surface located approximately halfway between cup floor 102 and ledge 168. Between cup floor 102 and cup shelf 104 is semicircular wall 103. Between ledge 168 and cup shelf 104 is semicircular wall 155. Between brim 162 and cup floor 102 is cup wall 159. At the tips of the horseshoe shape of cup shelf 104 are spring holes 141 and 142. Spring holes 141 and 142 are generally rectangular shaped apertures in semicircular wall 155. Hinge cup indentions 143 and 144 define the horseshoe shape of cup shelf 104. Additionally, spring hub hole 164 and spring hub hole 165 are located in semicircular wall 103. Arm hub hole 166 and arm hub hole 167 are located in cup wall 159. Spring hub hole 164 is the same diameter as and is concentrically aligned with spring hub hole 165 and is located on the opposite side of hinge cup 106. Further, arm hub hole 166 is the same diameter as and is concentrically aligned with arm hub hole 167. Tab 148 is a small flange located on semicircular wall 103 underneath cup shelf 104.

Figure 3:
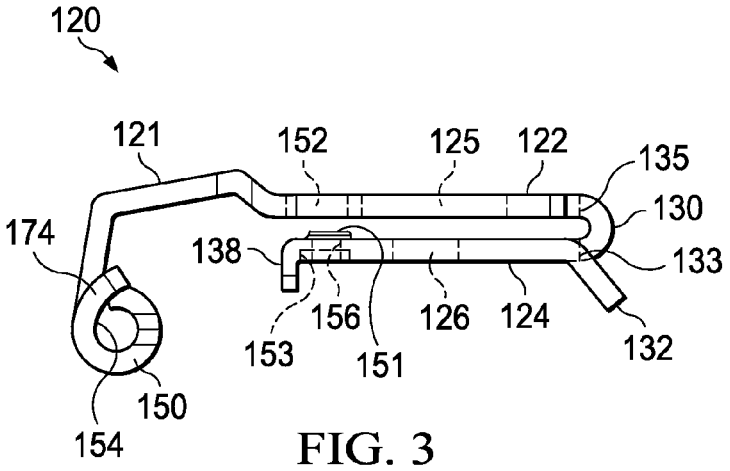
FIG. 3 is an elevation view of a hinge arm, attachment plate and abutment plate of a preferred embodiment of the present invention.
Figure 4:
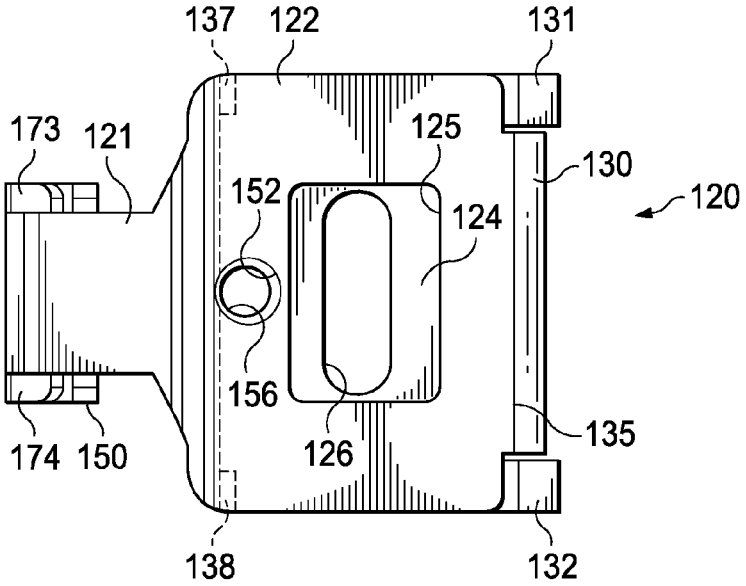
FIG. 4 is a plan view of a hinge arm, attachment plate and abutment plate of a preferred embodiment of the present invention.

Hinge arm 120 is shown in FIGS. 3 and 4. Hinge arm 120 is comprised of arm hook 150, arm section 121, adjustment plate 122, hinge section 130, and abutment plate 124. Arm hook 150 is located at one end of hinge arm 120 and defines a hollow tubular channel shown as pivot hole 154. Cam surfaces 173 and 174 are tabs extending from arm hook 150. Arm hook 150 extends into arm section 121. Arm section 121 leads to adjustment plate 122. Adjustment plate 122 and abutment plate 124 are connected to each other by hinge section 130. Hinge section 130 is a semi-cylindrical deformable plate with an approximate interior radius of 0.75 millimeters. Hinge section 130 is connected along first longitudinal axis 135 to adjustment plate 122. Hinge section 130 is also connected along second longitudinal axis 133 to abutment plate 124. In one preferred embodiment, the hinge section is integrally formed with the adjustment plate and the abutment plate. Adjustment plate 122 is generally parallel to and nearly adjacent to abutment plate 124 separated at one end by the interior diameter of hinge section 130. Adjustment plate 122 includes a generally rectangular shaped access hole 125 located generally in the center of adjustment plate 122. In the preferred embodiment, the major axis of the rectangular shaped aperture is approximately 16 mm and the minor axis of the rectangular shaped aperture is approximately 7 mm. Adjustment plate 122 also includes overlay adjustment screw hole 152. Abutment plate 124 includes elongated positioning slot 126. Positioning slot 126 is axially aligned with access hole 125 of adjustment plate 122 and with the axis of pivot hole 154. In the preferred embodiment, positioning slot 126 is approximately 14 millimeters in length. Abutment plate 124 further includes gripper 131 and gripper 132 located on one end of abutment plate 124 and flanking hinge section 130. Gripper 131 and gripper 132 are small flanges extending from abutment plate 124 at approximately 50 degrees. Also included on abutment plate 124 and located on the opposite end from gripper 131 and gripper 132 are guides 137 and 138. The distance between guide 137 and gripper 131 is equal to the distance between guide 138 and gripper 132. In the preferred embodiment, this distance is approximately 20 millimeters. This distance can be increased or decreased in order to adapt to the width of the cabinet frame support member to which the hinge is to be attached. Guides 137 and 138 are small tabs extending generally perpendicularly from abutment plate 124. Also included on abutment plate 124 is seat 151. Seat 151 is a generally rectangular shaped protrusion extending from abutment plate 124 towards adjustment plate 122. Cavity 153 resides directly below seat 151 and forms a generally rectangular indention. Seat 151 defines seat hole 156. Seat hole 156 is an unthreaded circular aperture with a diameter slightly less than that of overlay adjustment screw hole 152. In certain embodiments seat hole 156 is not present, but is replaced by a mating surface on the abutment plate surface.

Figure 5:
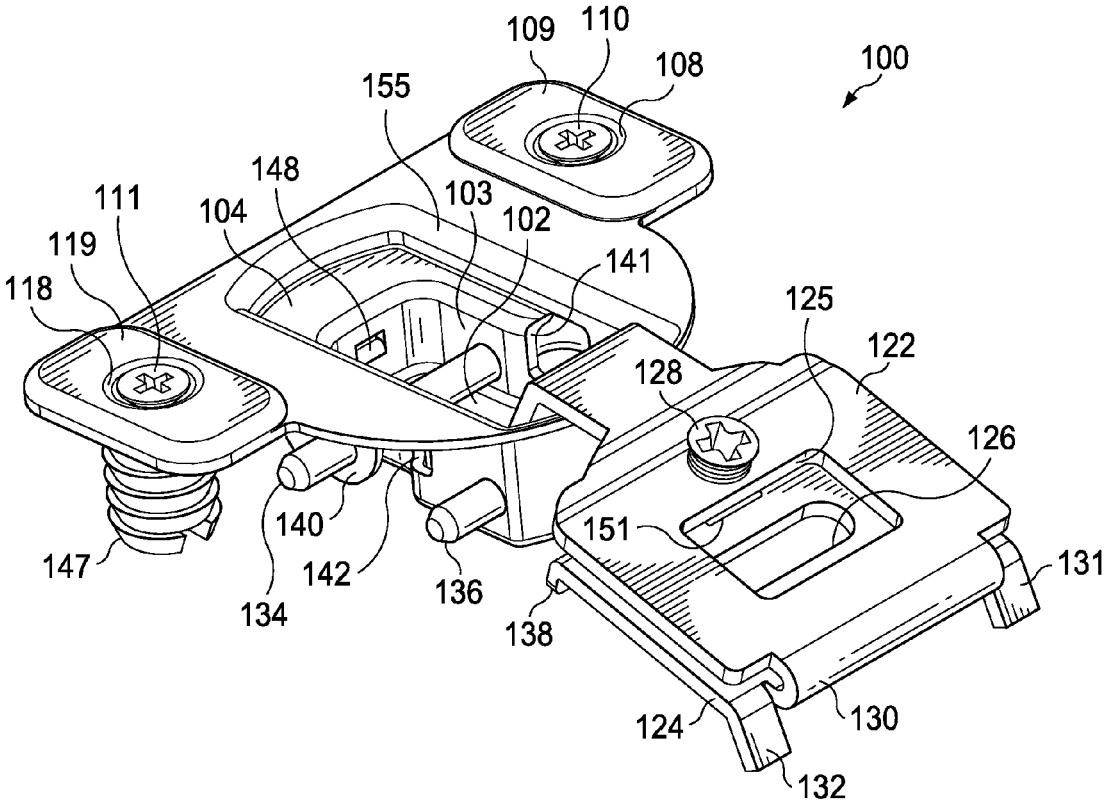
FIG. 5 is an isometric view of a preferred embodiment of the present invention.
Figure 6:
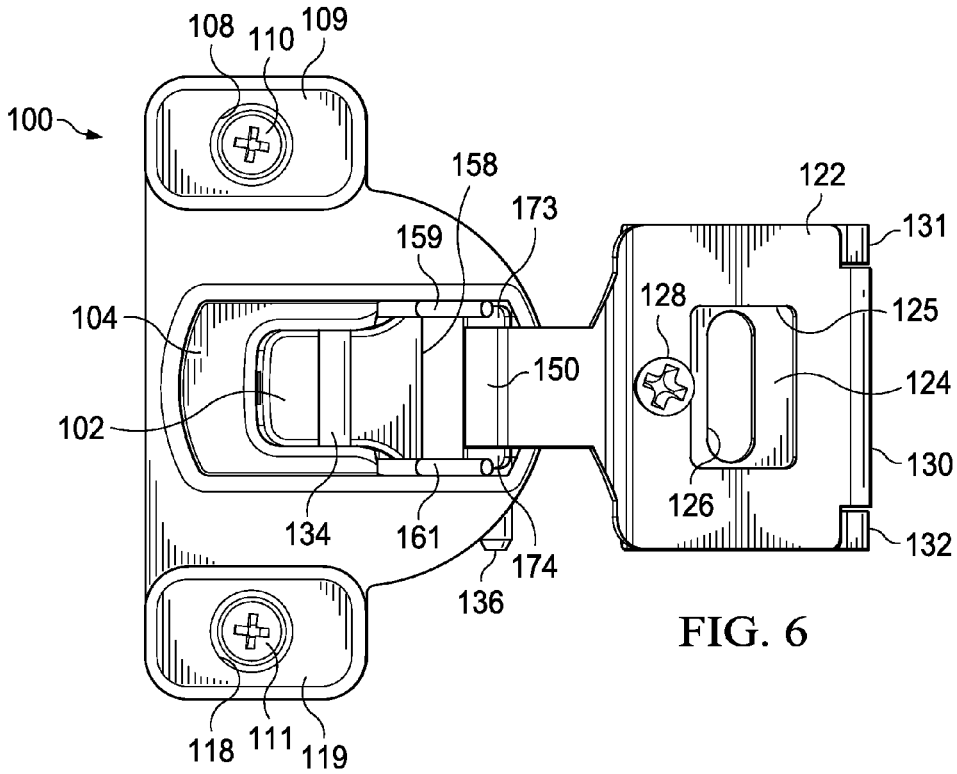
FIG. 6 is a topside plan view from above a preferred embodiment of the present invention.
Figure 7:
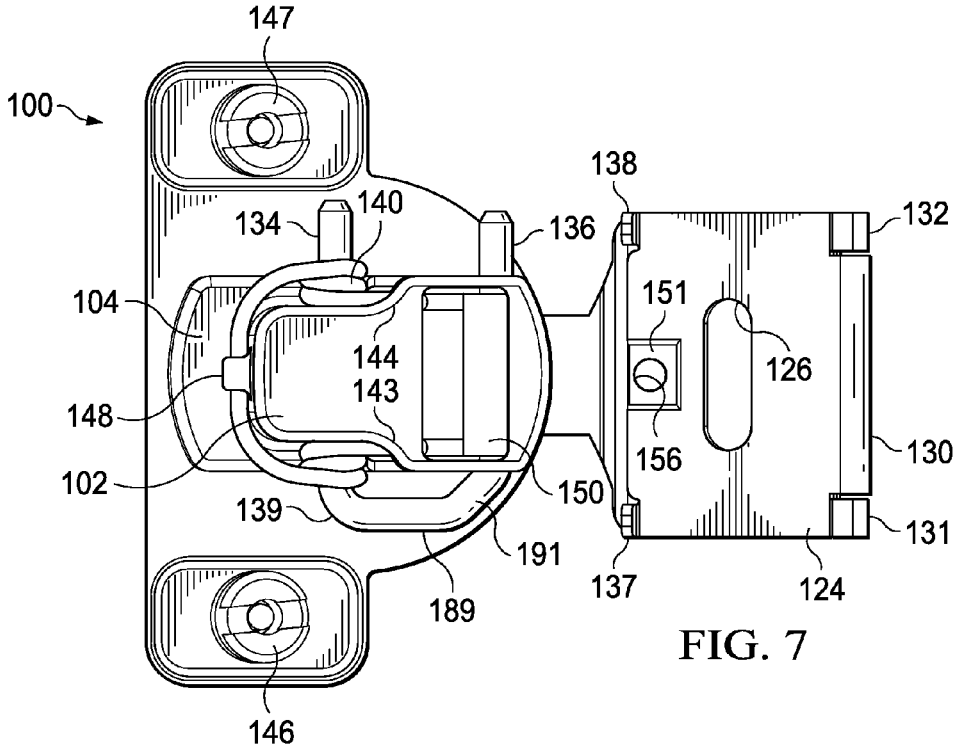
FIG. 7 is an underside plan view from below a preferred embodiment of the present invention.

Referring to FIGS. 5, 6, and 7, a preferred embodiment of adjustable hinge 100 having a hinge arm having multiple sections capable of an overly adjustment is shown. Adjustable hinge 100 serves for pivotally connecting a piece of furniture to a door. Adjustable hinge 100, when assembled, generally includes hinge cup 106, pin 139, coil spring 140, and hinge arm 120. Pin 139 is a solid shaft formed into a generally three sided rectangular shape. Pin 139 is shaped to accommodate the semicircular shape of brim 162. In the preferred embodiment, the diameter of pin 139 is approximately 3 millimeters. Pin 139 is comprised of four sections, spring hub 134, arm hub 136 and connector sections 189 and 191. Arm hub 136 provides an axle for pivotally connecting hinge arm 120 to hinge cup 106. Spring hub 134 provides an axle for pivotally supporting coil spring 140 with respect to hinge cup 106. Spring hub 134 and arm hub 136 simultaneously fit through and are seated in spring hub holes 164 and 165 and arm hub holes 166 and 167 respectively. Of course those skilled in the art will recognize that spring hub 134 and arm hub 136 can be replaced by separate keeper pins. Wood screws 110 and 111 are shown in flange holes 108 and 118 and are ultimately seated in anchors 146 and 147 respectively. Adjustment overlay screw 128 is seated in overlay adjustment screw hole 152 of adjustment plate 122 directly above seat 151.

Coil spring 140 wraps around the exterior of semicircular hinge wall 103 and rests on tab 148. Coil spring 140 follows the exterior of hinge cup 106 to where spring hub 134 extends out of hinge cup 106 on both sides. Coil spring 140 is wound around spring hub 134 and then extends into the interior of hinge cup 106 through both spring holes 141 and 142. Ends 159 and 161 of coil spring 140 rest simultaneously on cam surfaces 173 and 174.

Adjustable hinge 100 is constructed such that its overall longitudinal length is minimized. In a preferred embodiment, hinge cup 106 and hinge arm 120 each have a longitudinal length of approximately 36 millimeters and an overall length of approximately 65 millimeters when assembled. However, other lengths are acceptable as well within the scope of the invention. It is of course to be understood that the present invention is not limited to the identified connecting components and that other connecting components may be used. For example, it is known in the art to use a 4 bar linkage system comprised of multiple hinge arm elements connected to the hinge plate. The adjustment plate, deformable hinge plate and abutment plate can be adapted to this configuration.

In the preferred embodiment, hinge cup 106 and hinge arm 120 are typically constructed of metal such as cast aluminum or steel alloy plate stock and formed from casting or stamping but can also be made of injection molded plastic or nylon. In the preferred embodiment, the material used to construct hinge cup 106 is approximately 0.8 millimeters thick and the material used to construct hinge arm 120 is approximately 1.5 millimeters thick.

Figure 8:
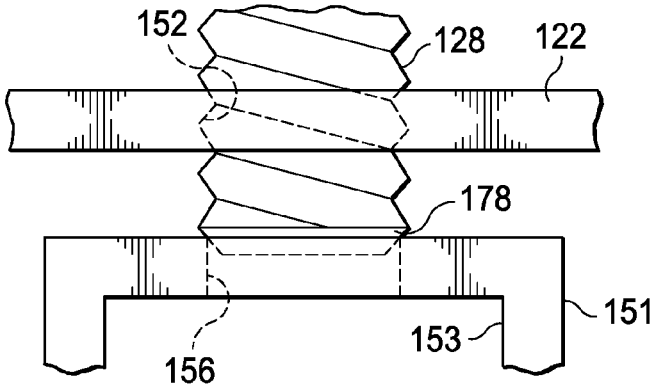
FIG. 8 is an elevation view of an overlay adjustment screw and seat of a preferred embodiment of the present invention.
Figure 9:
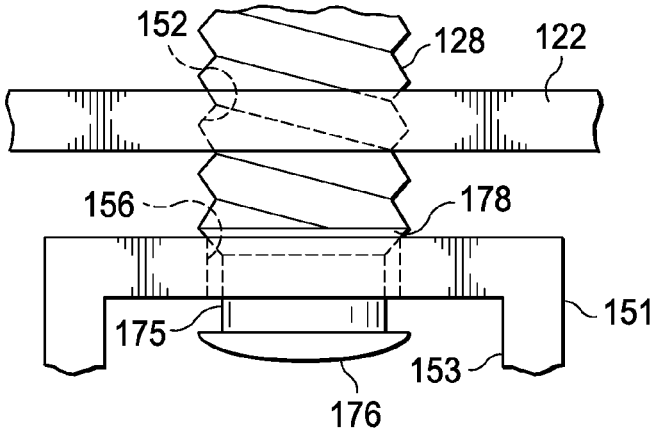
FIG. 9 is an elevation view of an overlay adjustment screw and seat of an additional preferred embodiment of the present invention.
Figure 10:
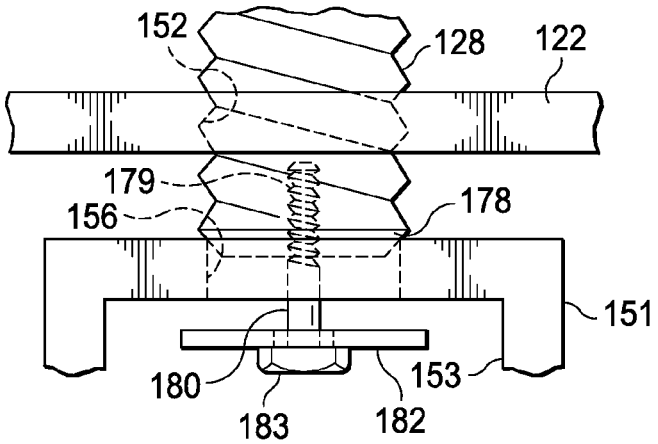
FIG. 10 is an elevation view of an overlay adjustment screw and seat of an additional preferred embodiment of the present invention.

FIGS. 8, 9, and 10 show alternate embodiments of overlay adjustment screw 128. Overlay adjustment screw 128 is threaded through overlay adjustment screw hole 152 of adjustment plate 122 and contacts seat 151 of abutment plate 124. This embodiment of overlay adjustment screw 128 has bevel 178. Bevel 178 is a portion of overlay adjustment screw 128 where the screw's diameter is lessened to a diameter smaller than the diameter of seat hole 156.

FIG. 8 shows bevel 178 of overlay adjustment screw 128 contacting seat 151 and seat hole 156 into cavity 153.

FIG. 9 shows overlay adjustment screw 128 passing completely through seat hole 156. In this embodiment, the end of overlay adjustment screw 128 includes cap shaft 175 and cap 176. Cap shaft 175 has a diameter less than the diameter of seat hole 156. Cap shaft 175 passes through seat hole 156 and leads to cap 176. Cap 176 resides in cavity 153 and is large enough to prevent it from passing through seat hole 156. In the preferred embodiment, cap 176 is formed on the end of cap shaft 175 of overlay adjustment screw 128 by deforming the end of cap shaft 175 after it has passed through seat hole 156 with the aid of a punch or hammer. Deforming the end of overlay adjustment screw 128 prevents it from passing through seat hole 156 yet still allows rotation of overlay adjustment screw 128. In another similar embodiment, cap 176 is a separate hemispherical button welded or attached to cap shaft 175 with a suitable epoxy adhesive.

FIG. 10 shows overlay adjustment screw 128 including bolt 180 and washer 182. Bolt 180 is threaded into threaded hole 179 tapped into the end of overlay adjustment screw 128. Washer 182 resides around bolt 180 between bolt head 183 and seat 151. Washer 182 allows overlay adjustment screw 128 and bolt 180 to rotate with respect to seat 151. Washer 182 and bolt head 183 reside in cavity 153 and are large enough to prevent them from passing through seat hole 156.

Figure 11:
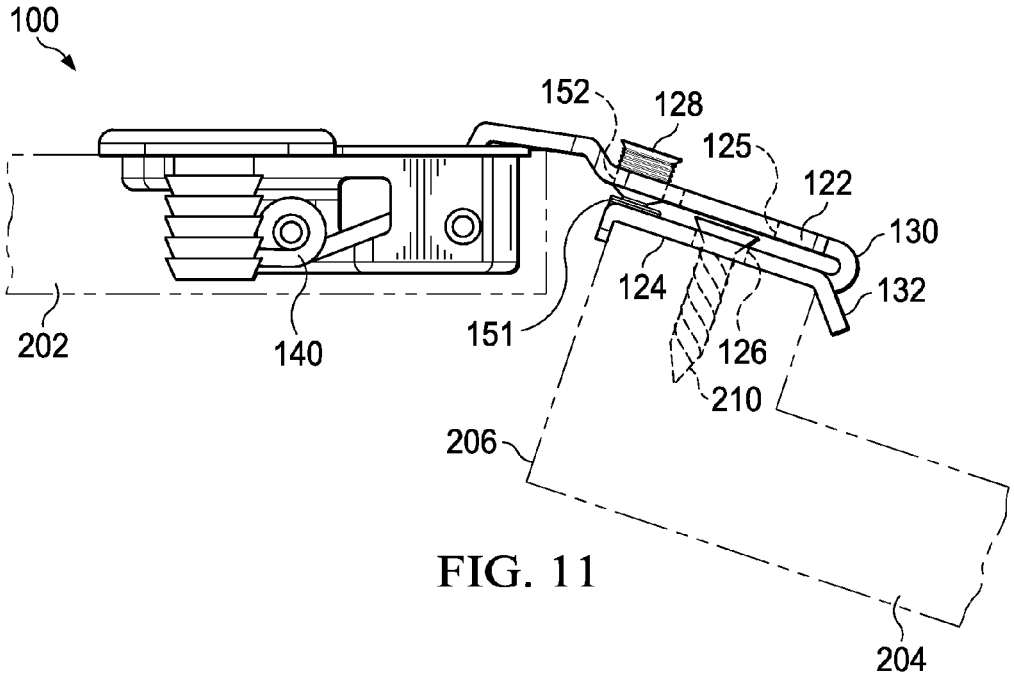
FIG. 11 is an elevation view of a preferred embodiment of the present invention in use.
Figure 12:
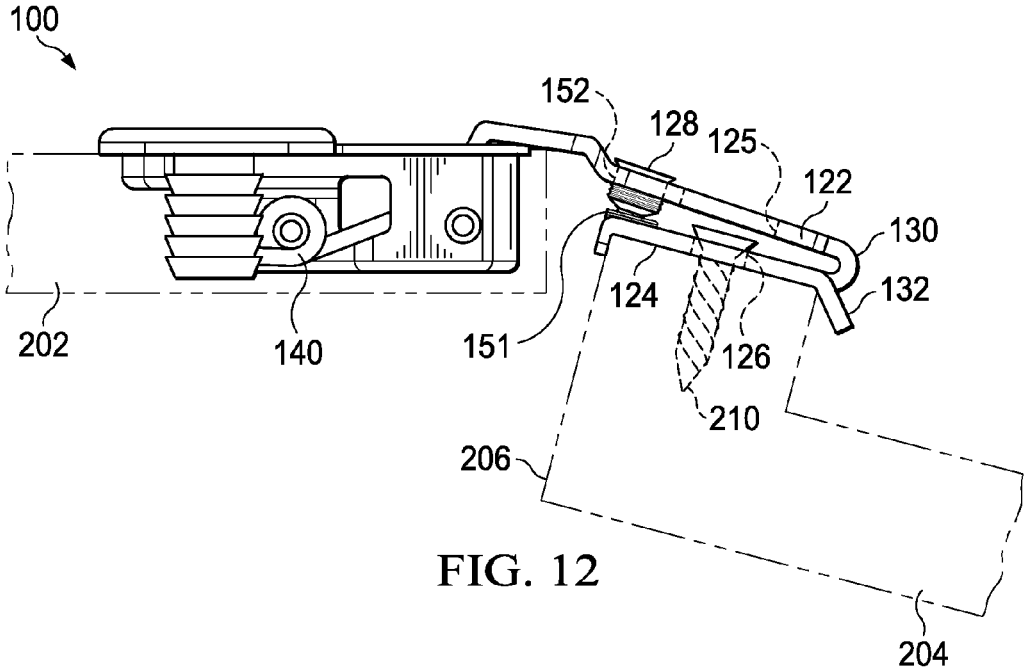
FIG. 12 is an elevation view of a preferred embodiment of the present invention showing an overlay adjustment in use.

FIGS. 11 and 12 show adjustable hinge 100 mounted to door member 202 and cabinet member frame 204. Hinge cup 106 is typically mounted in a semicircular bore in the door member of a conventional door and cabinet application with wood screws 110 and 111. The screws are inserted through flange holes 108 and 118 of flanges 109 and 119 respectively and are held secure with anchors 146 and 147 embedded into predrilled holes in the door member. The screws are tightened until ledge 168, brim 162, and flanges 109 and 119 abut the inside surface of door member 202.

The self-closing function of adjustable hinge 100 is accomplished by coil spring 140 biasing the hinge in one of an open or closed position. As hinge arm 120 pivots, ends 159 and 161 of coil spring 140 moves over cam surfaces 173 and 174 forcing adjustable hinge 100 to tend to rest on one side or the other of the cam surfaces in either the fully open position or the fully closed position.

Hinge arm 120 is pivotally connected at one end in hinge cup 106 via pin 139 and rotates about the concentric axes of arm hub 136 and pivot hole 154. Abutment plate 124 is attached to cabinet member frame 204 with wood screw 210 through positioning slot 126. The elongated shape of positioning slot 126 allows for vertical adjustments of the door member with respect to the cabinet frame. Door member 202 may be vertically adjusted to the proper height of an adjacent door member or adjoining cabinet member by loosening wood screw 210 inserted through positioning slot 126 and repositioning door member 202 to the desired height and retightening the wood screw. Access hole 125 in adjustment plate 122 is positioned to permit access to the screw regardless of the screw's location in positioning slot 126. For additional connection strength additional wood screws can be used in the positioning slot to attach the abutment plate to the cabinet frame.

As can be seen in FIGS. 11 and 12, abutment plate 124 is mounted adjacent to cabinet member frame 204. Guides 137 and 138 are placed in contact with one corner of the cabinet frame to ensure that abutment plate 124 is squarely aligned with cabinet member face 206 by slightly protruding around the corner of cabinet member face 206 and the inside door opening of cabinet member frame 204. Gripper 131 and gripper 132 are placed in contact with the opposite corner of the cabinet frame to further secure abutment plate 124 to the cabinet frame.

Hinge arm 120 of adjustable hinge 100 includes an overlay adjustment capability. An overlay adjustment moves the cabinet door horizontally with respect to the cabinet frame. An overlay adjustment also serves to align the edges of the door with the edges of other doors or drawers positioned on the cabinet frame. In most applications, more than one adjustable hinge 100 is used to mount a door member. Providing different overlay adjustments on two different hinges provides an angular adjustment to the cabinet door with respect to the cabinet frame. An overlay adjustment also contributes to proper closure of the door thereby prolonging cabinet and hinge useful life or providing adequate clearance for latching hardware.

FIG. 11 shows adjustable hinge 100 before an overlay adjustment. FIG. 12 shows adjustable hinge 100 after an overlay adjustment.

In operation, turning overlay adjustment screw 128 clockwise advances it through overlay adjustment screw hole 152 and causes the screw to abut seat 151. Bevel 178 of overlay adjustment screw 128 freely rotates in and is guided by seat hole 156. Further clockwise rotation of overlay adjustment screw 128 results in adjustment plate 122 rotating about the longitudinal axis of hinge section 130 with respect to abutment plate 124 by bending the hinge section. Rotation of the overlay adjustment screw increases the distance between the attachment plate and the cabinet frame at the location of the overlay adjustment screw. Further, those skilled in the art will realize that the invention provides a stable long term adjustment because the hinge section 130 is semi-permanently deformed by advancement of the adjustment screw and will hold an adjustment virtually indefinitely thereby eliminating the need for periodic readjustment.

A preferred embodiment where overlay adjustment screw 128 includes cap shaft 175 and cap 176 is shown in FIG. 9. Referring then to FIGS. 9, 11 and 12, advancing the overlay adjustment screw in a clockwise direction results in the same horizontal movement of the cabinet door with respect to the cabinet frame as described above. However, retraction of the overlay adjustment screw results when it is rotated in a counterclockwise direction. When rotated in a counterclockwise direction, the overlay adjustment screw withdraws cap 176 so that cap 176 abuts seat 151 and thus moves adjustment plate 122 towards abutment plate 124 resulting in movement of the cabinet door horizontally with respect to the cabinet frame but in the opposite direction.

Another preferred embodiment which allows overlay adjustments to be made in two directions is shown in FIG. 10. Referring then to FIGS. 10, 11 and 12, threaded bolt 180 resides in threaded bore 179 in the end of overlay adjustment screw 128. Washer 182 allows overlay adjustment screw 128 to rotate. As the overlay adjustment screw is rotated counterclockwise, washer 182 abuts seat 151 and moves adjustment plate 122 towards abutment plate 124 resulting in movement of the cabinet door horizontally in the opposite direction.

The vertical adjustments via positioning slot 126 and the overlay adjustments via overlay adjustment screw 128 are easily performed by one person assembling the door member with the cabinet frame member. No special tools are required. Use of an easily obtainable scredriver or spanner head wrench in all that is required. The adjustments can be minor and precise.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An adjustable hinge for mounting a cabinet door having a receiving bore to a cabinet frame comprising:

a hinge cup adapted to reside in the receiving bore;

a pair of mounting flanges attached to the hinge cup for attaching the hinge cup to the cabinet door;

a spring retaining tab on the hinge cup;

a pair of coaxially aligned spring retaining holes in the hinge cup;

a pair of coaxially aligned hinge arm mounting holes in the hinge cup;

a hinge arm having a tubular mounting hole and further comprising a first cam surface and a second cam surface;

the hinge arm rotatably mounted in the hinge cup by an axle pin having a first axis through the hinge arm mounting holes and the tubular mounting hole;

a coiled bias spring having a pair of helical coils and a first end and a second end adjacent the helical coils and a connecting arch between the helical coils;

the coiled bias spring further attached to the hinge cup whereby the connecting arch is adjacent the spring retaining tab, the pair of helical coils is coaxially aligned with the pair of hinge mounting holes and retained by a retaining pin through the retaining holes, and the first end is in sliding contact with the first cam surface and the second end is in sliding contact with the second cam surface;

an adjustment plate rigidly attached to the hinge arm and having an access hole and a threaded overlay adjustment hole;

an abutment plate having an elongated cabinet frame mounting hole for adjustably attaching the abutment plate to the cabinet frame;

a rigidly deformable unitary hinge plate connecting the adjustment plate and the abutment plate whereby the access hole is adjacent the elongated cabinet frame mounting hole;

a first set of guide flanges extending from the abutment plate at approximately 50 degrees adjacent to and flanking opposite edges of the rigidly deformable unitary hinge plate for contact with the cabinet frame;

a second set of guide flanges extending generally perpendicularly from the abutment plate for contact with the cabinet frame wherein the first set of guide flanges and the second set of guide flanges cooperate to center the abutment plate on the cabinet frame;

wherein the hinge arm is of one-piece construction including the adjustment plate, the abutment plate, and the rigidly deformable unitary hinge plate; and a threaded adjustment means, mounted in the threaded overlay adjustment hole and in contact with the abutment plate whereby when the threaded adjustment means is rotated the adjustment plate is angularly displaced with respect to the abutment plate by plastic deformation of the rigidly deformable unitary hinge plate.

2. The adjustable hinge of claim 1 wherein the threaded adjustment means further comprises a threaded screw rotatably attached to a seating means on the abutment plate for advancement and retraction of the adjustment plate.

3. The adjustable hinge of claim 2 wherein the seating means further comprises:

a raised seat platform on the abutment plate having a seating hole therethrough; and, a retaining means adjacent the seating hole and rigidly attached to the threaded adjustment means.

4. The adjustable hinge of claim 3 wherein the retaining means further comprises an extension shaft on the adjustment means extending through the seating hole and terminating in a mushroom cap of diameter larger than the hole.

5. The adjustable hinge of claim 3 wherein the retaining means further comprises a cavity adjacent the seating hole and a keeper surface on the threaded adjustment means of larger diameter than the seating hole.

6. The adjustable hinge of claim 1 wherein the rigidly deformable unitary hinge plate has a bending axis that is generally parallel to the first axis.

* * * * *